US012808180B2

(12) United States Patent
Sellier et al.

(10) Patent No.: US 12,808,180 B2
(45) Date of Patent: Nov. 24, 2026

(54) BRACING ACCESSORY

(71) Applicant: SAINT-GOBAIN ISOVER, Courbevoie (FR)

(72) Inventors: Julien Sellier, Charbonnieres les Bains (FR); Jean-Bernand Sidre, Simandre (FR); Hervé Debus, Saint Martin les Tatinghem (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 542 days.

(21) Appl. No.: 18/303,231

(22) Filed: Apr. 19, 2023

(65) Prior Publication Data

US 2023/0340776 A1 Oct. 26, 2023

(30) Foreign Application Priority Data

Apr. 22, 2022 (FR) ..... 2203760

(51) Int. Cl.
*E04B 1/38* (2006.01)
*E04B 1/76* (2006.01)

(52) U.S. Cl.
CPC ..... *E04B 1/388* (2023.08); *E04B 1/7675* (2013.01)

(58) Field of Classification Search
CPC ..... E04B 1/7675; E04B 1/388
USPC ..... 52/404.2
See application file for complete search history.

(56) References Cited

U.S. PATENT DOCUMENTS 2,697,857 A * 12/1954 Eckel ..... F16B 5/06 52/506.05
3,738,217 A * 6/1973 Walker ..... F16B 21/16 411/510
3,798,710 A * 3/1974 Tinnerman ..... E04F 13/0814 24/457
4,139,975 A * 2/1979 Baker ..... F16B 5/00 432/247
4,244,269 A * 1/1981 Gorell ..... E04D 3/3601 411/525
4,842,465 A * 6/1989 Pease ..... F16L 59/12 411/522
5,299,403 A * 4/1994 Fentz ..... E04F 13/0835 52/745.12
5,518,215 A * 5/1996 Lyons ..... F24F 13/0218 248/309.2
9,447,584 B2 * 9/2016 Farahmandpour .... E04F 13/007
9,932,740 B2 * 4/2018 Farahmandpour ..... E04B 1/388
(Continued)

FOREIGN PATENT DOCUMENTS

DE 102021128507 A1 * 5/2023 ..... F16B 5/065
EP 3190242 A1 * 7/2017 ..... E04F 13/0805
(Continued)

OTHER PUBLICATIONS

Search Report as issued in French Patent Application No. FR2203760, dated Nov. 17, 2022.

*Primary Examiner* — Brian E Glessner
(74) *Attorney, Agent, or Firm* — CUSHMAN PARTNERS LLC

(57) ABSTRACT

A bracing accessory adapted to attach at least one insulating product onto a wall surface to be lined, includes a rod, a first end of which is adapted to be attached to a structural element of the wall, and a second end of which is adapted to pass through the insulating product and a sealing membrane.

19 Claims, 5 Drawing Sheets

(56) References Cited

U.S. PATENT DOCUMENTS

| | | | | |
|---|---|---|---|---|
| 2014/0260036 | A1* | 9/2014 | Freeman | E04D 7/00 52/412 |
| 2016/0194864 | A1* | 7/2016 | Walker | E04B 5/023 52/745.05 |
| 2023/0340776 | A1* | 10/2023 | Sellier | E04F 13/0807 |

FOREIGN PATENT DOCUMENTS

| | | | | |
|---|---|---|---|---|
| EP | 3112547 | B1 * | 8/2018 | E04B 9/183 |
| FR | 2661207 | A1 * | 10/1991 | |
| FR | 2 826 390 | A1 | 12/2002 | |
| FR | 3022935 | A1 * | 1/2016 | E04F 13/0805 |
| FR | 3 050 747 | A1 | 11/2017 | |
| FR | 3 068 998 | A1 | 1/2019 | |
| FR | 3050747 | B1 * | 9/2020 | E04F 13/081 |

* cited by examiner

[Fig. 1]
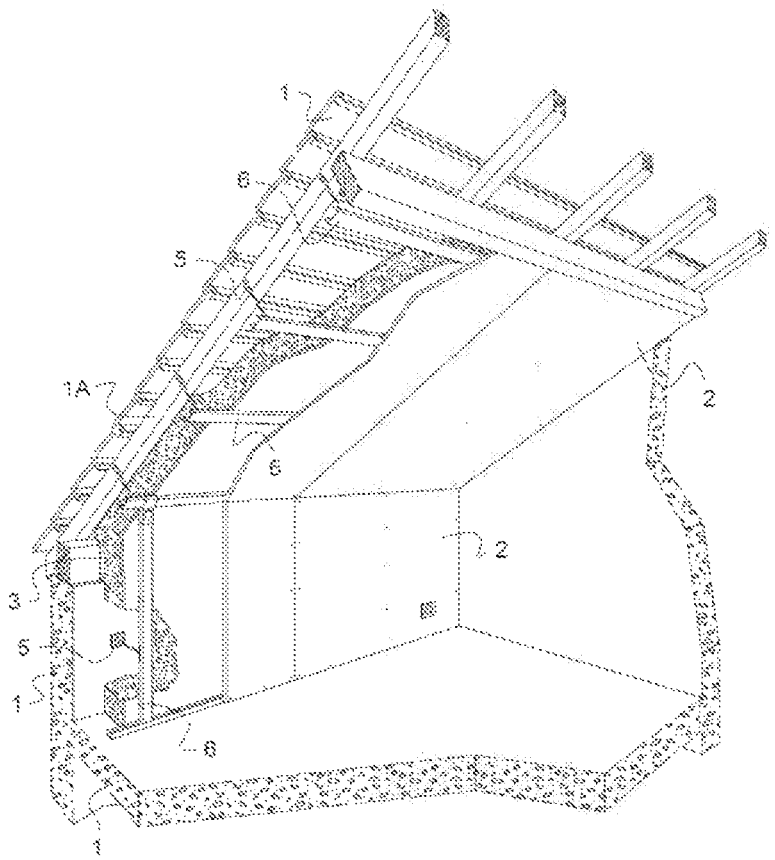
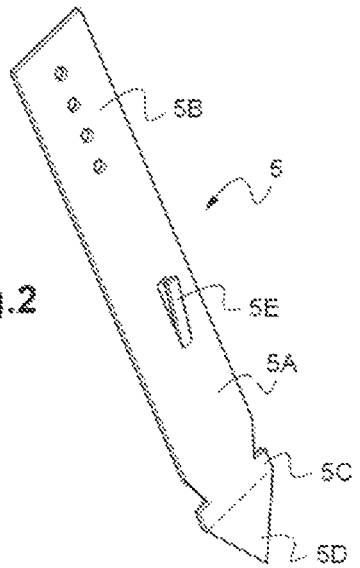
Fig.2

[Fig. 3]
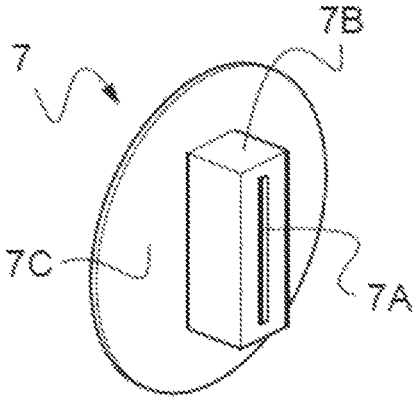
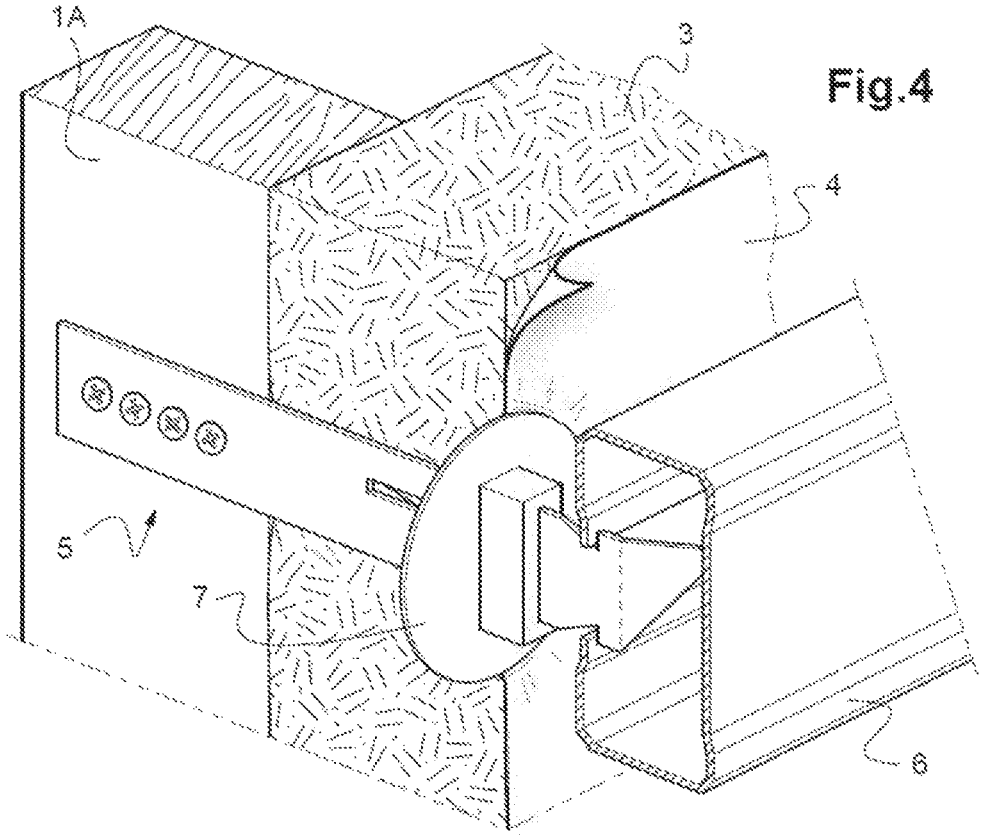
Fig.4

[Fig. 5]
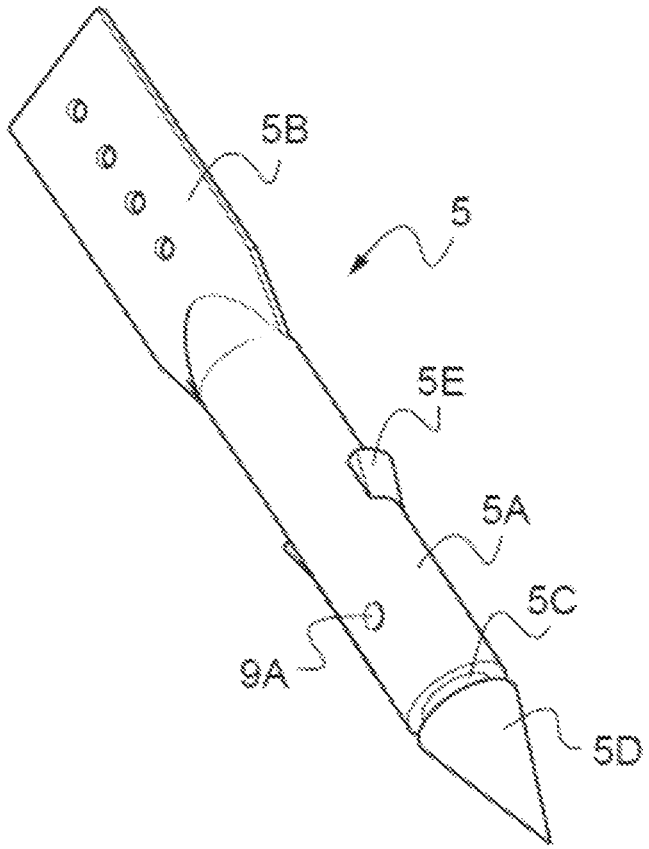
[Fig. 6]
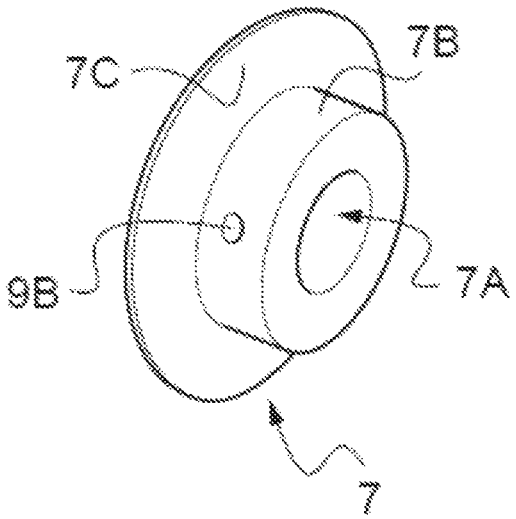

BRACING ACCESSORY

CROSS REFERENCE TO RELATED APPLICATIONS

This application claims priority to French Patent Application No. 2203760, filed Apr. 22, 2022, the entire content of which is incorporated herein by reference in its entirety.

FIELD

The present invention relates in general to wall surface lining for insulation or aesthetic purposes. In particular, it relates to a bracing accessory arranged between a wall surface to be lined and a cladding, in order to keep the latter away from the wall surface to be lined.

BACKGROUND

As illustrated in FIG. 1, the lining of a wall surface such as a wall, ceiling or roof of a building from the interior is frequently practiced, during renovation or new construction, to obtain or improve the acoustic or thermal insulation of a building or of a specific room. For this purpose, a cladding 2 is attached to a lining frame, which is itself attached to structural elements 1A of the wall surface 1 to be lined, at a given distance from it. A thermal and/or acoustic insulation packing (often referred to as an insulation coating) is inserted between the wall surface 1 to be lined and the cladding 2.

The insulation packing typically includes, on the one hand, one or more layers of an insulating product 3, such as mineral wool (glass, rock), a biosourced insulator such as wood fiber, or a cellular reflector insulator, in the form of foldable panels or rolls and, on the other hand, at least one sealing membrane 4, i.e. a vapor barrier membrane and/or fretting-vapor brake. This membrane 4 is most often interposed between the insulating product 3 and the cladding 2, typically adjoining the cladding, and/or optionally inserted between two layers of insulating product. Alternatively, it can be rigidly connected to the insulating product 3, or added separately between the latter and the cladding 2.

The lining frame is attached to the structural elements 1A of the wall surface 1 to be lined by means of regularly spaced bracing accessories 5, commonly called "hangers" for ceiling and roof lining, and "bracings" for wall lining. Each bracing accessory comprises a rod-shaped main body 5 extending transversely to the wall surface 1 to be lined and to the cladding 2. A first end of the accessory is provided with an attachment that is cantilevered to a structural element of the wall surface 1 to be lined, while a second end is provided with a fastening onto a filler plate 6 of a lining frame.

During installation, the insulation packing is plugged onto the rods of the bracing accessories 5, causing multiple piercing of the insulating product 3 and the membrane 4. This piercing is particularly damaging to the membrane 4, as its sealing function, permanent or selective, is then impaired. The membrane 4 piercing may also constitute a tear trigger which can spread if tension is exerted on the membrane.

The publication FR2925929A1 describes the implementation of a pair of jaws which, after locking by clipping in a groove arranged at the second end of the rod of a hanger, then clamp a sealing membrane near its point of perforation by the rod, in order to ensure the continuity of the sealing.

Such a hanger, although effective, nevertheless has a few drawbacks, including the irreversible nature of the attachment thereof, unless the jaws are destroyed.

SUMMARY

An aspect of the invention is intended to provide a technical solution to the disadvantages described hereinbefore. More particularly, in at least one embodiment, the proposed technique relates to a bracing accessory suitable for attaching at least one insulating product to a wall surface to be lined, comprising a rod, a first end of which is adapted to be attached to a structural element of the wall surface, and a second end of which is adapted to pass through the insulating product and a sealing membrane, the bracing accessory comprising a sealing element comprising a hole, for example a through-hole, the perimeter of which has a shape complementary to the cross-section of the rod and is made of an elastic material suitable for allowing reversible elastic attachment by friction of the sealing element on the rod and wherein the rod is of substantially flat shape, for example metallic.

The expression "reversible elastic attachment" refers to the non-definitive attachment of one piece to another by elastic deformation. Following the attaching of the bracing accessory to the wall surface to be lined and as a function of the density of the insulating product implemented, that product is either plugged directly onto the rod (mineral wool, cellular reflector insulator), or attached to the latter (rigid wood fiber insulation panels), such that the rod is slid between two consecutive insulating panels. In both cases, the second end of the rod passes right through the insulating product, within the meaning of the invention. By analogy, in an embodiment, the rod passes through the sealing element on the one hand, at the hole provided for this purpose. Following the plugging of the sealing membrane onto the second end of the rod, an operator inserts the sealing element around the rod via the hole provided for this purpose, then slides the sealing element against the membrane, the elastic properties of the sealing element allowing it to deform elastically to match the perimeter of the rod while exerting a compression force on the latter, under the effect of the elastic return. The sealing element is then resiliently attached to the rod by opposing a frictional resistance, i.e., of a tribological nature, to its removal. Such a sealing element nevertheless remains removable if a sufficient traction force is exerted by an operator. The elastic nature of the material present at the interface between the rod and the sealing element allows the latter to perfectly follow the surface of the rod, and thus to maximize the contact surface and the desired sealing properties at this interface.

An aspect of the invention thus relies on an inventive concept consisting of providing a bracing element that is both simple to use and removable, while offering satisfactory air-tightness around the rod. The implementation of a reversible elastic attachment of the sealing accessory onto the rod also makes it possible to adapt the positioning of the sealing accessory according to the requirements of the operator, for example the thickness of the insulating product(s) and especially the final positioning of the sealing membrane. In other words, it is not necessary at the moment of manufacturing the bracing accessory to predefine an area for attaching the sealing element to the rod.

Within the meaning of the invention, the rod is said to be "substantially flat" in the sense that it extends mostly in the same theoretical plane, while preferably having slight folds at the lateral edges thereof and/or embossing lines, in order to increase its rigidity. For example, the term "substantially flat" is meant to account for the slight deviations due to the manufacturing process. Prefacing the term "flat" with "substantially" is meant to account for those configurations in which the rod (except for the slight folds and embossing lines) departs from a strict flat configuration, but remains approximately flat due to the manufacturing process. A rod of substantially flat shape has the benefit of offering an increased contact surface for a sealing accessory, thus facilitating satisfactory sealing and reliability.

According to a particular embodiment, the sealing element comprises a rise in which the hole is formed, and which, for example, extends along the axis of the rod over a distance greater than 2 mm, for example greater than 5 mm, such as greater than 10 mm.

Such a rise makes it possible to increase the contact surface between the sealing element and the rod, and thus to reinforce the seal at this interface.

According to a particular embodiment, the rise extends from a flat base, for example of circular, oval, square or diamond shape, for example coated with an adhesive and/or gripping coating, the flat base being adapted to abut against the sealing membrane during the insertion of the sealing element onto the rod.

By coming into contact with the sealing membrane, along a plane orthogonal to the axis of the rod, such a flat base makes it possible to cover possible tears in the membrane around its insertion opening, and thus to reinforce its sealing power.

According to a particular embodiment, the elastic material constituting at least the perimeter of the hole, otherwise the entirety of the sealing element, has a Shore A hardness of between 20 and 100, in an embodiment between 30 and 80, and in an embodiment belongs to the group comprising elastomers, for example rubber, butyl, compounds including styrene, butadiene or ethylene, compounds including polyester, polyproproylene or EPDM, polyurethane or thermoplastic olefins.

The selection of such an elastic material makes it possible, at the hole, to easily implement a reliable, leaktight and reversible attachment.

According to a particular embodiment, the entirety of the sealing element is made up of the elastic material. The manufacture of such a one-piece sealing element is easier to produce, in comparison with a sealing element formed by a plurality of different materials.

According to a particular embodiment, the sealing element comprises at least one so-called rigid material which has a flexural modulus greater than 100 MPa, in an embodiment greater than 1000 MPa, and in an embodiment belongs to the group comprising metals and thermoplastics, and which constitutes said flat base and/or the periphery of the rise.

The selection of such a relatively rigid material, in comparison with the elastic material arranged on the perimeter of the through-hole, makes it possible to improve the contact of the flat base with the membrane and/or to facilitate the gripping of the sealing accessory by an operator.

According to a particular embodiment, the sealing element comprises a device (e.g. a locking member) adapted to reversibly lock the sealing element onto the rod, such as a key.

The implementation of an additional reversible locking member makes it possible, in addition to the reversible elastic attachment by friction already provided by the sealing element at the hole thereof, to reinforce the attachment of the sealing element onto the rod, such that it can for example better support the weight of the insulating product.

According to a particular embodiment, the sealing element is formed from two jaws adapted to grip the rod in a reversible elastic attachment configuration by friction of the sealing element onto the rod.

The implementation of such jaws makes it possible to fasten the sealing element directly to the rod, without it being necessary to slide the latter from the second end of the rod, and in particular through its tip.

According to a particular embodiment, the two jaws are pivotally connected.

According to a particular embodiment, the two jaws are two separate parts, and in an embodiment they are connected by a hinge. According to a particular alternative embodiment, the two jaws form part of the same part which has a folding line adapted to allow the pivoting of one jaw relative to the other.

According to a particular embodiment, the rod comprises at its second end a tip, which is in an embodiment foldable between a so-called plugging configuration, in which the tip is arranged in the extension of the rod, and a configuration in which all or part of the tip is tilted outside the axis of the rod.

The tip at the end of the rod makes it possible to facilitate the plugging of the insulating product(s) and the membrane. On the other hand, tilting the tip to the side after plugging makes it possible to avoid exposing an operator to this tip, once installed, and optionally to allow the clip-fastening of a filler plate.

According to a particular embodiment, the rod comprises at its second end a device for fastening to a filler plate, which in an embodiment comprises two grooves arranged at the periphery of the rod, in a theoretical plane orthogonal to the axis of the rod.

The rod of the bracing accessory can thus be attached directly to a filler plate in order to ensure satisfactory mechanical connection, independent of the sealing element.

According to a particular embodiment, the rod comprises at least one member for holding the insulating product which protrudes on the rod, and which in an embodiment comprises a tooth or a flap.

Such a holding member makes it possible to retain the insulating panel, for example when the latter tends to slide on the rod under its own weight According to a particular embodiment, the rod comprises a rough surface adapted to come into contact with the perimeter of the hole of said sealing element.

Such a surface area with increased roughness, in comparison with the rest of the rod, makes it possible to reinforce the attachment of the sealing accessory to the rod, by increasing the frictional resistance to the rod coming loose.

According to a particular embodiment, the bracing accessory comprises a cup adapted to be arranged between the insulating product and the membrane and to form a counter-support to the sealing element in order to clamp the membrane around its insertion opening.

According to a particular embodiment, the cup is adapted to be mounted slidably pivoting around the rod.

According to alternative embodiments, the cup is attached to the rod by a reversible elastic attachment by friction and/or a reversible locking member.

An aspect of the invention also relates to an assembly comprising a wall surface to be lined provided with a structural element to which at least one such bracing accessory is attached, which passes through at least one insulating product and at least one sealing membrane.

According to alternative embodiments, an insulating panel is pre-equipped with a sealing membrane or without a sealing membrane, the membrane then being plugged separately onto the rod of the bracing accessory.

According to a particular embodiment, the at least one bracing accessory is attached to a filler plate, itself attached to a cladding.

According to a particular embodiment, the assembly comprises at least one acoustic damping member at the interface between the bracing accessory and the filler plate.

According to a particular embodiment, the acoustic damping member is arranged between the end of the rod close to its fold and the filler plate, in order to limit the propagation of sound waves and possible clicking noise between the rod and the filler plate.

Another aspect of the invention also relates to a method for attaching at least one insulating product to a wall surface to be lined, comprising at least the following steps, in this order:

- the first end of the rod of such a bracing accessory is attached to a structural element of the wall surface,
- at least one insulating product is placed against the wall surface, such that the rod passes right through,
- plugging a sealing membrane, and the sealing element of the bracing accessory, onto the second end of the rod.

In yet another aspect, the invention also relates to a method for lining a wall surface, comprising the implementation of a method for attaching at least one such insulating product and the mounting of at least one filler plate on said bracing accessory, and of a cladding on said filler plate.

BRIEF DESCRIPTION OF THE DRAWINGS

Further features and benefits of the invention will become apparent from the following description of particular embodiments, given merely as illustrative and non-limiting examples, and the appended figures, for which:

FIG. 1 is a perspective view, with cutaway, of the interior of a building, the roof and walls of which are insulated by means of a lining assembly known from the prior art, FIG. 2 is a schematic perspective view of the rod of a bracing accessory according to a first embodiment of the invention, FIG. 3 is a schematic perspective view of a sealing element of a bracing accessory according to a first embodiment of the invention, FIG. 4 is a schematic perspective view of an assembly formed by a wall surface to be lined, a bracing accessory, and a filler plate, according to a first embodiment of the invention, FIG. 5 is a schematic perspective view of the rod of a bracing accessory according to a second embodiment of the invention, FIG. 6 is a schematic perspective view of a sealing element of a bracing accessory according to a second embodiment of the invention.

DETAILED DESCRIPTION

The various elements illustrated in the figures are not necessarily shown to actual scale, the emphasis being more on representing the general operation of the invention. In the various figures, unless otherwise indicated, reference numbers that are identical represent similar or identical elements.

Several particular embodiments of the invention are presented below. It is understood that the present invention is in no way limited by these particular embodiments, and that other embodiments are perfectly possible.

Figure 8:
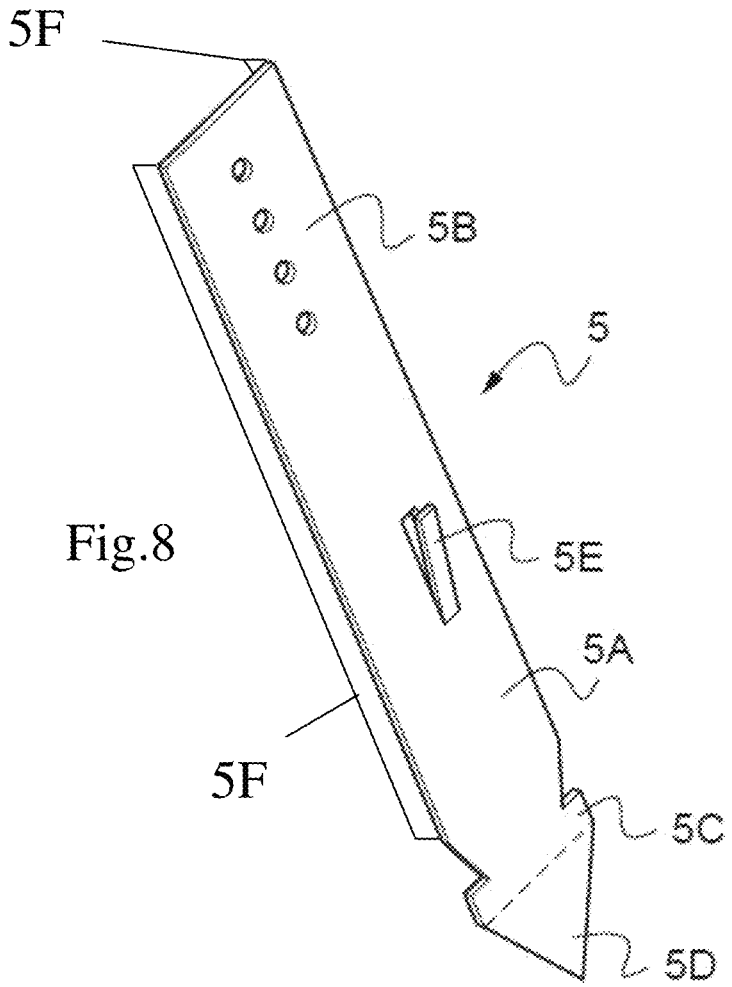

FIGS. 2 and 3 respectively show a rod 5A and a sealing element 7 of a bracing accessory 5 according to a first embodiment of the invention wherein the rod 5A of the accessory 5 is of substantially flat shape, and is of metallic nature. FIG. 4 depicts an assembly formed by a wall surface to be lined 1, such a bracing accessory 5 and a filler plate 6. FIG. 8 schematically shows a rod 5A that comprises folds 5F along the lateral edges.

In the context of a lining method according to this first embodiment, a first end of the rod 5A of the bracing accessory 5 is first attached to a structural element 1A of the wall surface 1. More specifically, and as illustrated by FIG. 4, this attachment is implemented via perforations formed in a portion in the form of a plate 5B of the rod 5A, in which screws are engaged.

According to alternative embodiments, such a fastening of the rod to the structural element can be provided by any equivalent fastening system, for example by means of a head arranged at the first end of the rod, and adapted to be attached in a filler plate itself secured to the wall surface to be lined.

Once the bracing accessory 5 is attached to the wall surface 1, and as illustrated by FIG. 4, at least one insulating product 3 is placed against the wall surface 1, so that the rod 5A passes through the latter right from one side to the other.

According to alternative embodiments, the insulating product 3 is either plugged directly onto the rod 2A, or attached to the latter, so that the rod 2A is slid between two consecutive insulating panels 3. FIG. 4 allows for these two alternative embodiments, the apparent section of the insulating product 3 needing to be considered a cross-section in the first case, or as the edge of the insulating product 3 in the second case, to which the rod would be affixed.

Note the implementation on the rod of a tooth 5E which makes it possible to hold the insulating product on the rod, in particular during this step of mounting the insulating product 3. This tooth may be in the thickness of the insulating product or just below.

A sealing membrane 4 is subsequently plugged onto the rod 5A. The implementation of a tip 5D at the second end of the rod 5A facilitates the perforation and the subsequent plugging of the membrane 4.

It should be noted that according to alternative embodiments, the membrane 4 is either secured to the insulating product 3 during its manufacture, in which case they are plugged together at the same time, or produced separately, in which case the installation of the insulating product 3 and the membrane 4 is carried out in two distinct steps.

A sealing element 7 of the bracing accessory 5 is subsequently plugged onto the rod. More specifically, and as illustrated by FIG. 3, such a sealing element comprises a circular base 7C, at the center of which a through-hole 7A is formed extended by a rise 7B with a height greater than 10 mm, along an axis orthogonal to this flat base 7C. According to this first embodiment, the hole 7A is a slot, in order to have a shape complementary to the section of the rod, of substantially flat shape. The flat base 7C and the major part of the rise 7B of the sealing element 7 consist of a so-called rigid thermoplastic material, the flexural modulus of which is greater than 100 MPa. Only the slot 7A is coated with a soft rubber, the Shore A hardness of which is between 30 and 80.

To plug the sealing element 7, an operator inserts the sealing element 7 around the rod 5A via the slot 7A provided for this purpose, then slides the sealing element 7 and in particular its flat base 7C against the membrane 4. According to this first embodiment, the outer face of the base 7C of the sealing element 7, i.e. the face intended to be oriented toward the membrane 4, is coated with an adhesive in order to reinforce its sealing power. The elastic properties of the rubber constituting the inside of the slot 7A allow it to deform elastically to match the periphery of the rod 5A while exerting on the latter a compression force, under the effect of the elastic return. The sealing element 7 is also resiliently attached to the rod 5A by opposing a frictional resistance, i.e., of a tribological nature, to its removal. Such a sealing element 7 nevertheless remains removable if a sufficient traction force is exerted by an operator. The elastic nature of the rubber used at the interface between the rod 5A and the sealing element 7 also allows the latter to perfectly follow the surface of the rod 7A, and thus to maximize the contact surface and the desired sealing properties at this interface.

Prior to mounting a filler plate 6, and as shown in FIG. 4, the end of the tip 5D is tilted outside the axis of the rod (5A), along a fold line illustrated by dashed lines in FIG. 1. A filler plate 6 is subsequently inserted into two dedicated grooves 5C arranged at the rear of the tip 5D. According to a particular embodiment (not depicted), an acoustic damping member is arranged in those grooves, or between the end of the rod 5A close to its fold and the filler plate, in order to limit the propagation of sound waves and possible clicking noise between the rod 5A and the filler plate 6.

Finally, the lining method can be completed by attaching a cladding 2 (not shown in FIG. 4, but visible in FIG. 1) onto the filler plate 6, for example by screwing. The cladding 2 is thus kept at a distance from the wall surface 1 by means of the bracing accessory 5.

FIGS. 5 and 6 respectively show a rod 5A and a sealing element 7 of a bracing accessory 5 according to a second embodiment, which differs mainly from the first embodiment in that the rod 5A has a solid tubular shape and is made of a thermoplastic material. According to this second embodiment, the rod 5A has at a first end a plate 5B adapted to be screwed to a structural element 1A of the wall surface 1. According to alternative embodiments, not illustrated, such a fastening 5B can be provided by any equivalent system, for example a perforated plate arranged along the rod, along the axis of the rod.

The implementation on the rod 5A of a flap 5E makes it possible to hold the insulating product 3 on the rod, in particular during the step of mounting the insulating product 3.

Figure 7:
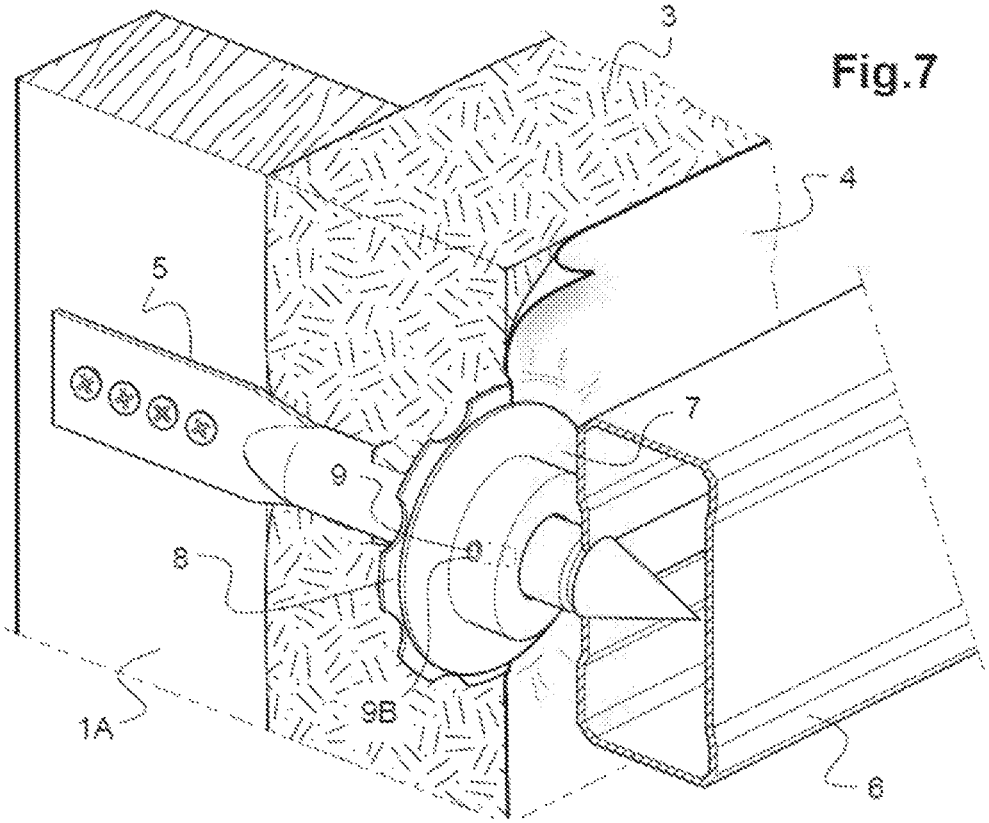
FIG. 7 is a schematic perspective view of an assembly formed by a wall surface to be lined, a bracing accessory, and a filler plate, according to a second embodiment of the invention, and FIG. 8 a schematic perspective view of the rod of a bracing accessory according to an embodiment of the invention.

According to this second embodiment, and as illustrated in FIG. 7, the insulating product 3 and the sealing membrane 4 are provided separately, and separated from one another in the final assembly by a cup 8 mounted slidably pivoting on the rod 5A. According to this second embodiment, the cup 8 has a geometry similar to that of the sealing element 7, with which it forms a counter-support in order to clamp the membrane 4 around its coupling opening. According to alternative embodiments, the cup may however have any geometric shape adapted to fulfill this counter-support function, and have any type of mechanical connection with the rod, for example an irreversible attachment, a reversible elastic attachment by friction, or a reversible attachment by screwing, or bayonet type. In the latter case, the cup 8 can provide a complementary function of retaining the insulating product 3, in order to reduce the stresses exerted by the latter on the sealing element 7.

As shown by FIGS. 6 and 7, a sealing element 7 comprises, in addition to a flat base of conical shape 7C, a through-hole 7A of cylindrical shape, extended by a tubular shape 7B of a height greater than 10 mm, along an axis orthogonal to this flat base 7C. As in the first embodiment, the perimeter of the hole 7A is coated with a soft rubber. In a manner analogous to the first embodiment, the shape complementarity and the elastic properties of the rubber constituting the inside of the hole 7A allow it to deform elastically to fit the periphery of the rod 5A while exerting on the latter a compression force, under the effect of elastic return. A satisfactory seal at this interface, as well as reversible attachment by friction, are thus ensured. In a complementary and non-essential manner, a blind hole 9A is produced on the periphery of the rod 9A, for, in collaboration with a through-hole produced in the upward 9B of the sealing element 7, allowing a key 9 to be inserted through. This makes it possible to reinforce the attachment of the sealing element 7 to the rod 9A, such that it can for example better support the weight of the insulating product. In a complementary or alternative manner, the rod 5A can have, on a portion of its perimeter, a surface with increased roughness, in order to reinforce the attachment of the sealing accessory to the rod, by increasing the frictional resistance to the rod coming loose.

After coupling the sealing element, and similarly to the first embodiment, the lining method can be completed by attaching a filler plate 6 and then a cladding 2. The cladding 2 is thus kept at a distance from the wall surface 1 by means of the bracing accessory 5.

The invention claimed is:

1. A bracing accessory suitable for attaching at least one insulating product to a wall surface to be lined, comprising a rod, a first end of which is adapted to be attached to a structural element of said wall surface, and a second end of which is adapted to pass through said insulating product and a sealing membrane, said bracing accessory comprising a sealing element comprising a hole having a perimeter that has a shape complementary to a cross-section of the rod and is made of an elastic material adapted to allow reversible elastic attachment by friction of said sealing element on the rod, wherein said rod is of substantially flat shape, and wherein the elastic material constituting at least the perimeter of the hole, otherwise the entirety of said sealing element, has a Shore A hardness of between 20 and 100.

2. The bracing accessory according to claim 1, wherein the hole is a through-hole.

3. The bracing accessory according to claim 1, wherein the rod is a metallic rod.

4. The bracing accessory according to claim 1, wherein said sealing element comprises a rise in which said hole is formed, and which extends along an axis of the rod over a distance greater than 2 mm.

5. The bracing accessory according to claim 4, wherein said rise extends from a flat base, said flat base being adapted to abut against the sealing membrane during the insertion of the sealing element onto the rod.

6. The bracing accessory according to claim 5, wherein said sealing element comprises at least one rigid material which has a flexural modulus greater than 100 MPa, and which constitutes said flat base and/or the periphery of the rise.

7. The bracing accessory according to claim 1, wherein said sealing element comprises a reversible locking member of said sealing element on the rod.

8. The bracing accessory according to claim 1, wherein said sealing element is formed from two jaws adapted to grip the rod in a reversible elastic attachment configuration by friction of said sealing element on the rod.

9. The bracing accessory according to claim 1, wherein said rod comprises at its second end a tip, which is foldable between a plugging configuration, wherein said tip is arranged in the extension of the rod, and a configuration in which all or part of the tip is tilted outside the axis of the rod.

10. The bracing accessory according to claim 1, wherein said rod comprises at its second end a device for fastening to a filler plate, which comprises two grooves arranged at the periphery of the rod, in a theoretical plane orthogonal to the axis of the rod.

11. The bracing accessory according to claim 1, wherein said rod comprises at least one member for holding the insulating product which protrudes on the rod.

12. The bracing accessory according to claim 1, wherein said rod comprises a rough surface adapted to come into contact with the perimeter of the hole of said sealing element.

13. The bracing accessory according to claim 1, further comprising a cup adapted to be arranged between said insulating product and the membrane and to form a counter-support to said sealing element in order to clamp the membrane around its insertion opening.

14. The bracing accessory according to claim 1, wherein said rod comprises folds at lateral edges thereof and/or embossing lines.

15. An assembly comprising a wall to be lined with a structural element to which at least one bracing accessory according to claim 1 is attached, which passes through at least one insulating product and at least one sealing membrane.

16. The assembly according to claim 15, wherein said at least one bracing accessory is attached to a filler plate, which is itself attached to a cladding.

17. A method for attaching at least one insulating product to a wall surface to be lined, comprising, in this order:

attaching a first end of the rod of a bracing accessory according to claim 1 to a structural element of said wall surface, placing at least one insulating product against the wall surface, such that said rod passes right through, and plugging a sealing membrane, and the sealing element of said bracing accessory, onto a second end of the rod.

18. A method for lining a wall, comprising implementing a method for attaching at least one insulating product according to claim 17, and mounting at least one filler plate onto said bracing accessory, and a cladding onto said filler plate.

19. The bracing accessory according to claim 1, wherein said sealing element is adapted to be slid along said rod and maintained in position solely by friction between the elastic material and the rod.

* * * * *